US006152326A

United States Patent [19]

Klima, Jr. et al.

[11] Patent Number: 6,152,326

[45] **Date of Patent: *Nov. 28, 2000**

[54] PROBE FOR RECHARGEABLE DISPENSERS

[75] Inventors: Walter F. Klima, Jr., Travelers Rest, S.C.; William L. Klima, Stafford, Va.

[73] Assignee: Sprayex, Inc., Rest, S.C.

[ * ] Notice: This patent is subject to a terminal disclaimer.

[21] Appl. No.: 09/082,469

[22] Filed: May 21, 1998

[51] Int. Cl.[7] ..... B67D 5/00

[52] U.S. Cl. ..... 222/82; 222/129; 222/383.1; 239/333

[58] Field of Search ..... 222/80–86, 129–136, 222/325, 383.1; 239/303, 304, 309, 333

[56] References Cited

U.S. PATENT DOCUMENTS

| | | | |
|---|---|---|---|
| 2,824,010 | 2/1958 | Pedersen | 99/171 |
| 3,080,094 | 4/1958 | Modderno | 222/82 |
| 3,134,505 | 5/1964 | Modderno | 222/82 |
| 3,548,562 | 12/1970 | Schwartzman | 53/25 |
| 3,655,096 | 4/1972 | Easter | 222/82 |
| 3,966,089 | 6/1976 | Klingaman | 222/83.5 |
| 4,177,938 | 12/1979 | Brina | 222/80 |
| 4,355,739 | 10/1982 | Vierkotter | 222/134 |
| 5,012,978 | 5/1991 | Bolduc | 239/304 |
| 5,421,483 | 6/1995 | Parise | 222/82 |
| 5,439,141 | 8/1995 | Clark et al. | 222/136 |
| 5,529,216 | 6/1996 | Klima et al. | 222/130 |
| 5,836,479 | 11/1998 | Klima et al. | 222/383.1 |
| 5,890,624 | 4/1999 | Klima et al. | 222/82 |

FOREIGN PATENT DOCUMENTS 1939086 7/1969 Germany .

*Primary Examiner*—Steven O. Douglas
*Assistant Examiner*—Timothy L. Maust
*Attorney, Agent, or Firm*—Klima & Pezzlo, P.C.

[57] ABSTRACT

An apparatus for use with rechargeable dispensers includes a spray head and a probe connected to the spray head for puncturing reservoirs of concentrated chemical. The probe includes a connecting portion for attaching the probe to the barrel of the spray head; a disc portion, the connecting portion and the disc portion defining a through hole; and a shaft portion connected to the disc portion at one end and defining a tip end at another end. The probe may also include more than one shaft portion. In one embodiment, a conventional downtube is modified to function as a probe.

46 Claims, 8 Drawing Sheets

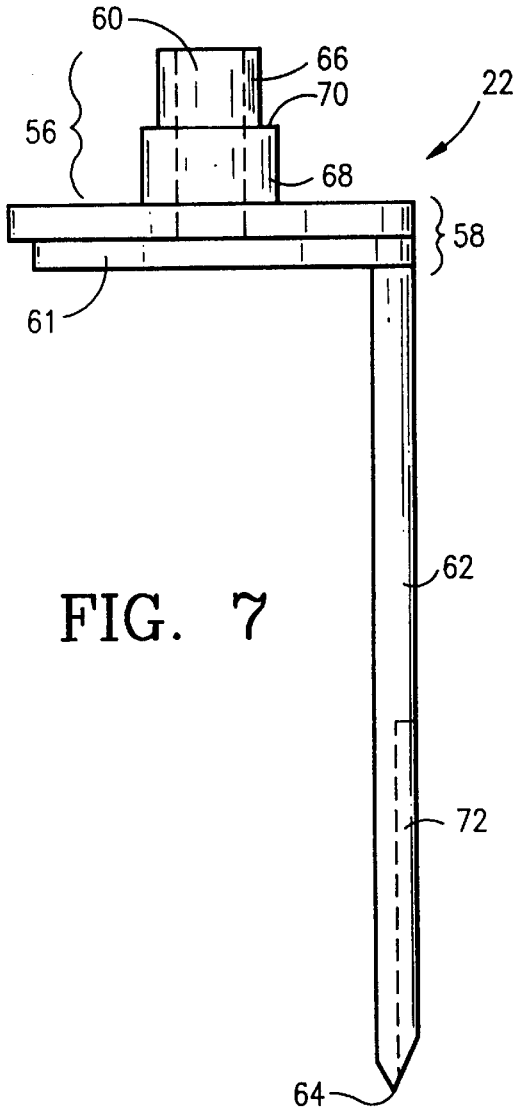
FIG. 7
FIG. 8
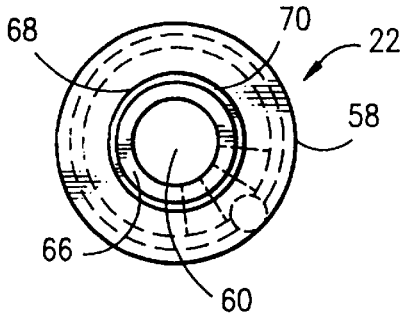
FIG. 9
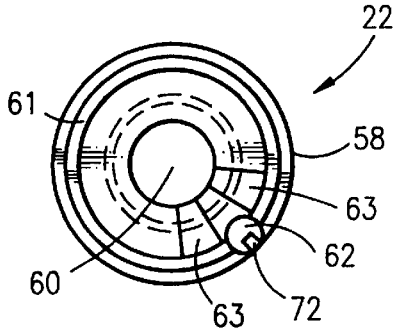
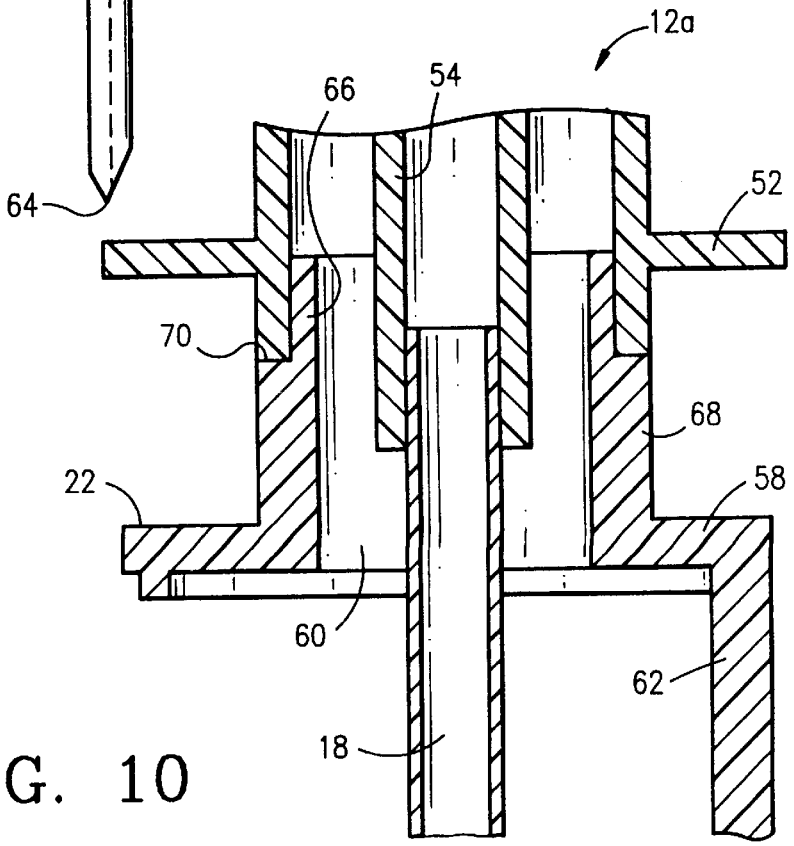
FIG. 10

FIG. 11
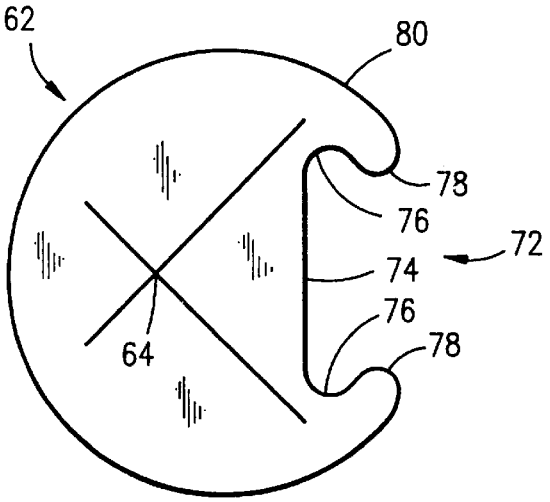
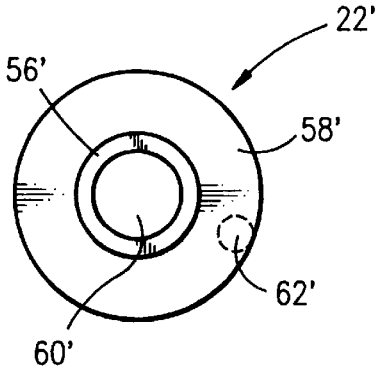
FIG. 13
FIG. 12
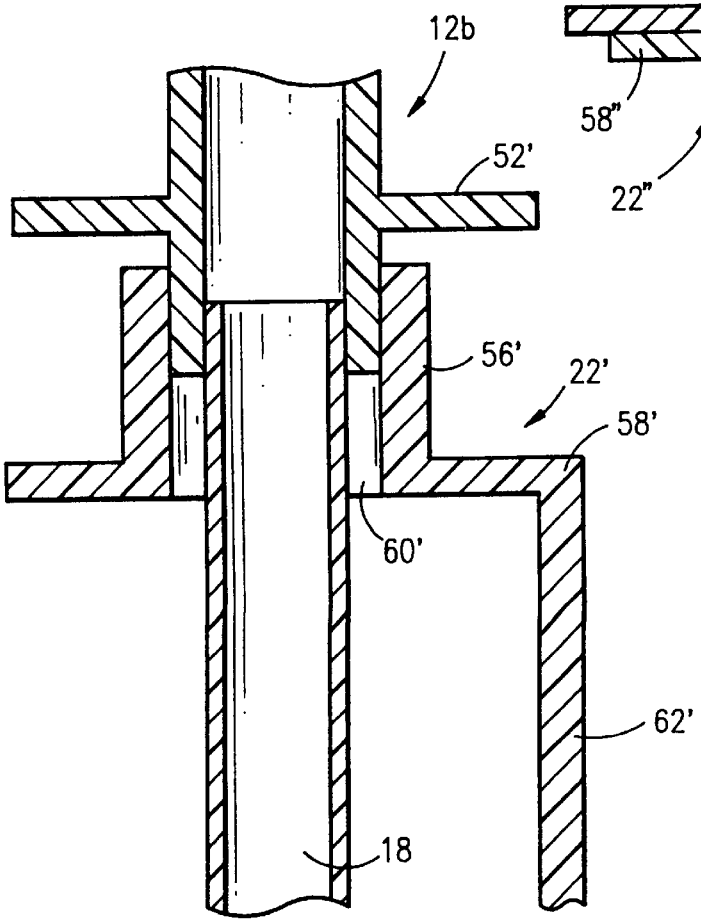
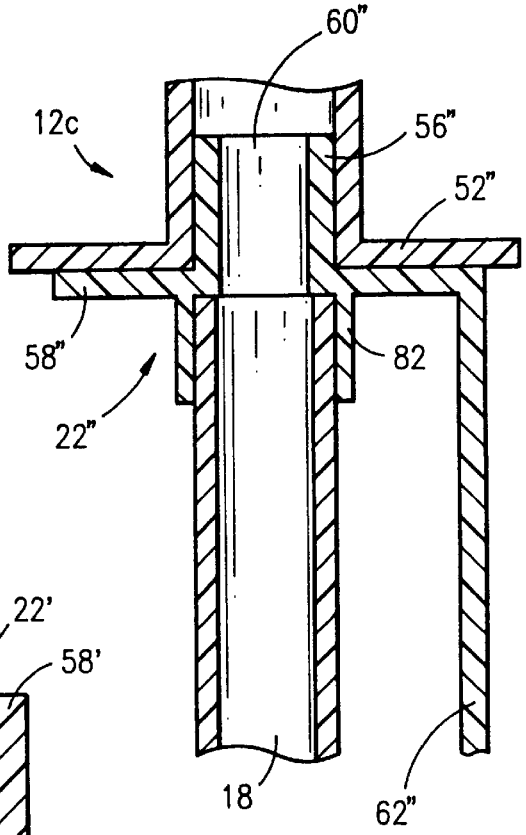
FIG. 14

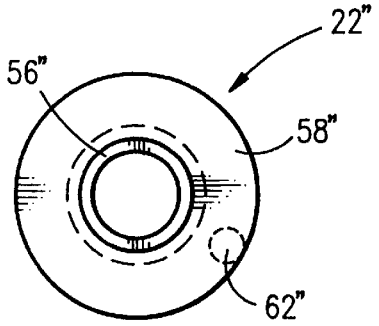
FIG. 15
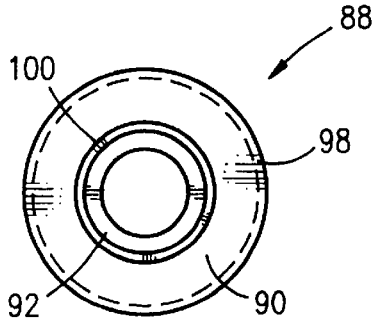
FIG. 17
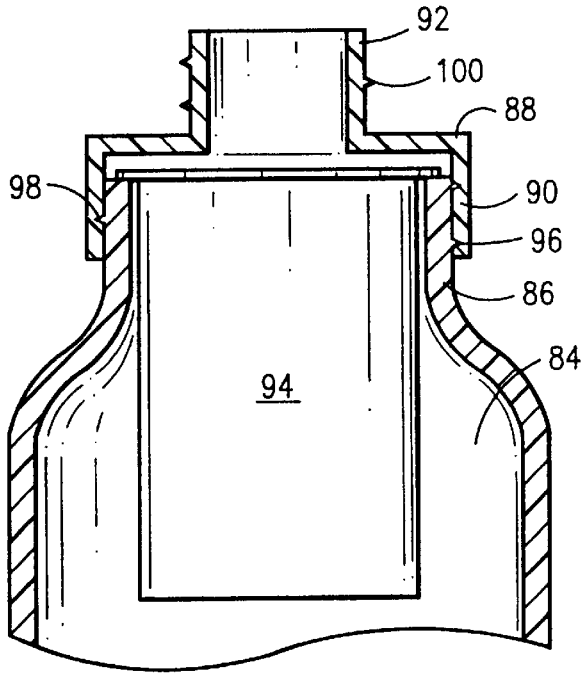
FIG. 16
FIG. 18
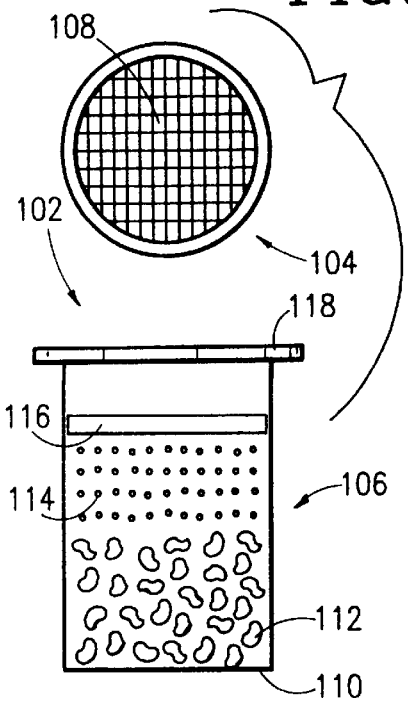
FIG. 19
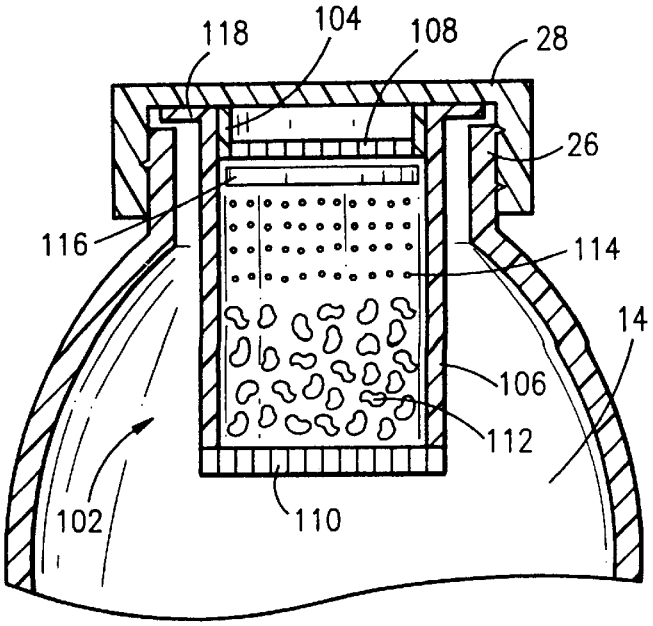

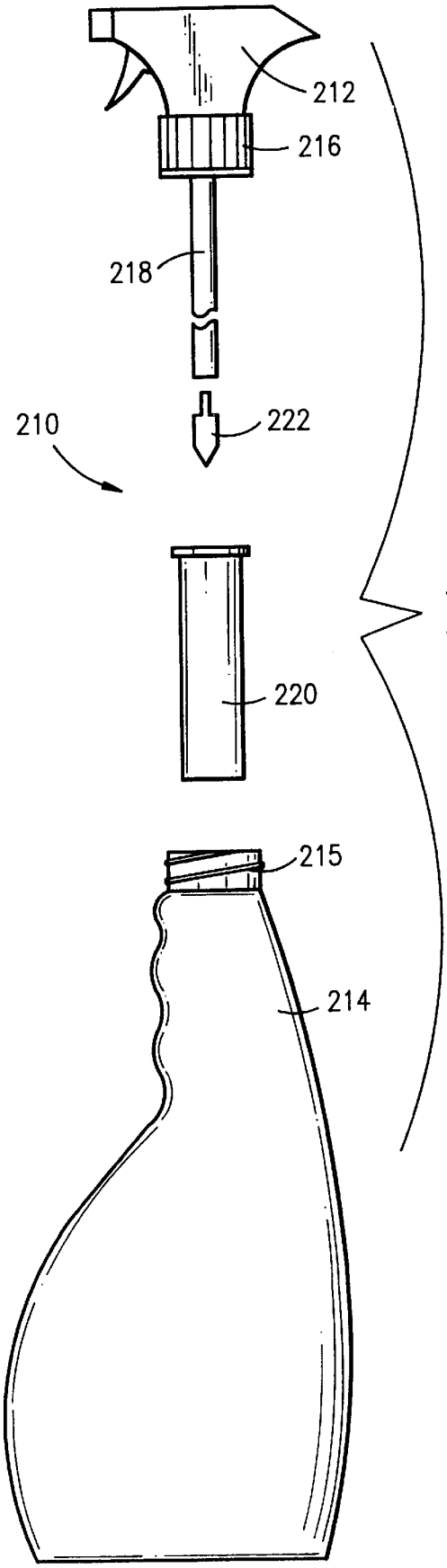
FIG. 25
FIG. 26
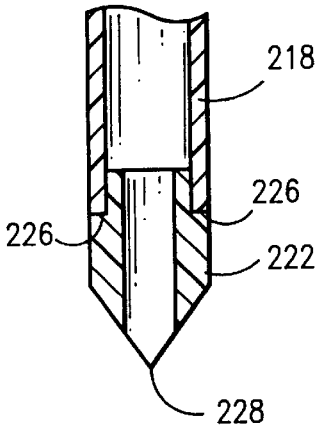
FIG. 27
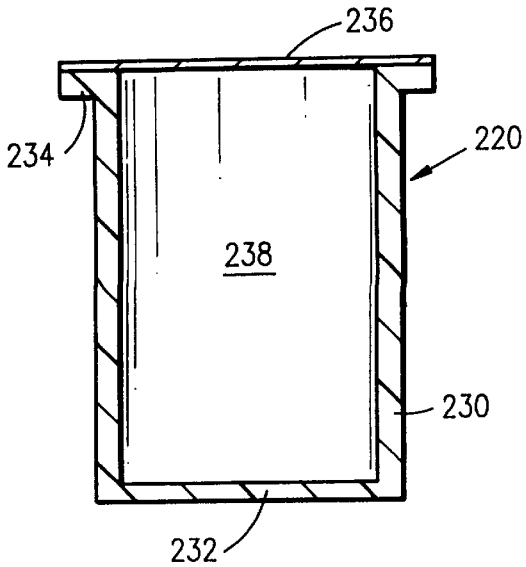

PROBE FOR RECHARGEABLE DISPENSERS

RELATED APPLICATIONS

The following related U.S. patent applications, having the same inventors as the present application, are herein fully incorporated by reference:

1) U.S. patent application entitled "Plastic Blow Molded Bottle", Ser. No. 09/009,739, filed Jan. 20, 1998;

2) U.S. patent application entitled "Rechargeable Dispensers", Ser. No. 08/963,913, filed Nov. 4, 1997;

3) U.S. patent application entitled "Rechargeable Dispensers", Ser. No. 08/507,691, filed Jul. 25, 1995, now abandoned;

4) U.S. patent application entitled "Rechargeable Dispensers", Ser. No. 08/485,254, filed Jun. 7, 1995;

5) U.S. patent application entitled "Rechargeable Dispensers", Ser. No. 08/279,978, filed Jul. 25, 1994, now U.S. Pat. No. 5,529,216.

6) U.S. patent application entitled "Multiple Neck Spray Bottle, and Methods of Making and Using", Ser. No. 08/808,575, filed Feb. 28, 1997;

7) U.S. design application entitled "Spray Bottle", Ser. No. 29/056,103, filed Jun. 21, 1996.

8) U.S. patent application entitled "Rechargeable Dispensers", Ser. No. 08/852,736, filed May 7, 1997;

9) U.S. patent application entitled "Rechargeable Containers and Dispensers", Ser. No. 08/897,838, filed Jul. 21, 1997.

FIELD OF THE INVENTION

The present invention relates to rechargeable dispensers, in particular, rechargeable spray bottle dispensers, that can be recharged or refilled. Specifically, the present invention is directed to spray bottle dispensers having one or more reservoirs containing chemical associated with the spray bottle dispensers so that the spray bottle dispensers can be recharged by simply adding water or some other suitable solvent, and accessing one or more of the chemical reservoirs to form a diluted chemical reagent.

BACKGROUND OF THE INVENTION

The use of spray bottles for dispensing chemical reagents (e.g., water, cleaners, soaps, insecticides, hair spray, etc.) is well known. Due to regulations limiting the amount of volatile organic carbons (VOC) released in the atmosphere, products originally contained and dispensed through aerosols are currently being replaced with spray bottles.

Bottlers of chemical reagents typically market their products by purchasing separately empty plastic container bottles and spray heads. The bottlers then fill, assemble, and label the completed spray bottle packages for delivery to retailers. Consumers purchase the filled spray bottles at the point-of-sale, and then use the chemical contents of the spray bottle. Most consumers dispose of the spray bottle upon the one time use of the contents of the spray bottles. However, the spray bottles are still fully functional with respect to containing and dispensing chemical reagents, since the plastic bottles are substantially chemically resistant and the spray heads remain fully functional after using the contents. Conventional point-of-sale type spray bottles can be recharged numerous times with chemical concentrate and water (i.e., at least 10 times, possibly 100 times while maintaining full operation). Thus, consumers dispose large quantities of reusable product (i.e, empty spray bottles) having high utility value.

In today's environment of numerous regulations to control pollution, and consumer and industrial awareness for conserving resources and reducing landfill waste, it is highly desirable to promote the reuse of products that maintain their utility, and dispose of only products that no longer have any utility. Many bottlers are currently selling concentrate in various sized containers to allow consumers to recharge point-of-sale type spray bottles with their particular concentrates. However, many consumers are unwilling to adopt such methods apparently due to some inconvenience in the steps involved with the recharging process of the spray bottles. In particular, there is some inconvenience in removing the spray head, opening the chemical concentrate container, pouring the chemical concentrate into the empty spray bottle, adding water, and reattaching the spray head to the bottle. Further, consumers apparently lack interest in recharging spray bottles due to some reluctance based on their inexperience and knowledge in mixing and diluting liquids, which is done by processing chemists for the bottlers. In addition, recharging is usually a messy undertaking due to spillage of chemical concentrate while pouring from one container to the other, overfilling, accidentally knocking over the bottle being filled due to its instability when unfilled, and other undesirable mishaps that can occur, that provide substantial inconveniences.

Importantly, sizeable containers (e.g., pint, quart, gallon, liter sizes) of chemical concentrate can be significantly hazardous to transport and handle by consumers unaware of the potent chemical properties of the chemical concentrates. Specifically, chemical spills of concentrate can damage items around the home including flooring, carpeting, counter top in kitchens and bathrooms, shelves, and other items the chemical concentrate could potentially come into contact with. Further, chemical concentrate can impose a significantly greater health risk to persons coming into accidental contact therewith potentially causing tissue burns and other damages.

Most importantly, chemical concentrate imposes a great risk to children who may accidentally ingest the chemical concentrate and become poisoned. Chemical concentrate greatly increases the chance of permanent injury or death in this regard to children versus current diluted chemical reagents contained in point-of-sale type spray bottles.

Our related, co-pending patent application Ser. No. 08/852,736, filed May 7, 1997 and entitled "Rechargeable Dispensers," discloses a bayonet (probe) for puncturing reservoirs of chemical concentrate contained within a spray bottle dispenser. In that patent application, the probe is attached to the downtube, which in turn is attached to the spray head. In the present invention, the probe is attached directly to the spray head.

SUMMARY OF THE INVENTION

An object of the present invention is to provide a rechargeable dispenser, in particular a spray bottle having one or more chemical concentrate reservoirs disposed within the spray bottle dispenser.

Another object of the present invention is to provide a rechargeable dispenser, in particular a spray bottle having one or more chemical concentrate reservoirs disposed within the spray bottle dispenser, and accessible by puncturing.

A further object of the present invention is to provide a probe for puncturing a chemical concentrate reservoir.

Still a further object of the present invention is to provide a probe for puncturing a chemical concentrate reservoir wherein the probe is connected to the spray head rather than the downtube.

Yet a further object of the present invention is to provide an adapter so that large neck spray bottles may receive spray heads having small couplers.

Another object of the present invention is to provide a diluent filter for a rechargeable dispenser so that diluent is filtered as it is added to the dispenser.

A still further object of the present invention is to provide a probe for simultaneously puncturing more than one chemical concentrate reservoir.

Another object of the invention is to provide an apparatus that can function as both a downtube and a probe to puncture an insert.

These and other objects of the invention are achieved by an apparatus for use with rechargeable dispensers comprising a spray head having a barrel and a probe connected to the spray head. The probe comprises a connecting portion for attaching the probe to the barrel; a disc portion, the connecting portion and the disc portion defining a through hole; and a shaft portion connected to the disc portion at one end and defining a tip end at another end.

In one embodiment, the spray head includes a movable piston and the connecting portion comprises a first cylindrical portion having an outside diameter, the first cylindrical portion being inserted into the barrel to form a non-locking press fit with an interior of the barrel; and a second cylindrical portion having an outside diameter larger than the outside diameter of the first cylindrical portion, the second cylindrical portion forming a stop against the barrel; wherein a downtube is inserted in the through hole of the disc and connecting portions and attached to the movable piston.

In another embodiment, the connecting portion is generally cylindrical, an interior surface of the connecting portion forms a non-locking press fit with an exterior surface of the barrel, a downtube is inserted in the through hole of the disc and connecting portions and the downtube is attached to the barrel.

In a further embodiment, the probe further comprises a generally cylindrical downtube insertion portion disposed on a lower surface of the disc portion and the connecting portion is generally cylindrical, an exterior surface of the connecting portion forms a non-locking press fit with an interior surface of the barrel and a downtube is attached to the generally cylindrical downtube insertion portion by insertion therein.

Preferably, the shaft includes a groove that extends to the tip end of the shaft portion and the groove is defined by a substantially flat portion, concave portions at each end of the substantially flat portion, and convex portions at ends of the concave portions distal the substantially flat portion.

Another aspect of the invention is a rechargeable spray bottle dispensing apparatus comprising a spray bottle including a first neck portion; a spray head connected to the first neck portion of the spray bottle, the spray head including a barrel; a downtube extending into the spray bottle; an insert having at least one reservoir for containing a dose of chemical concentrate; and a probe for selectively accessing the at least one reservoir of the insert, the probe being connected to the barrel of the spray head.

In a preferred embodiment, the spray bottle includes a second neck portion and a closure to allow a diluent to be added to the spray bottle without removing the spray head connected to the first neck portion of the spray bottle. A second insert for insertion in the second neck includes means for filtering diluent added through the second neck.

Yet another aspect of the invention is a rechargeable spray bottle dispensing apparatus comprising a spray bottle including a first neck portion; an adapter having a larger neck portion and a smaller neck portion, the larger neck portion for coupling to the first neck portion of the spray bottle; a spray head including a barrel, the smaller neck portion of the adapter for coupling to the spray head; a downtube extending into the spray bottle; an insert having multiple reservoirs for containing multiple separate doses of chemical concentrate, the insert being configured for selectively accessing the multiple reservoirs to allow multiple recharging of the spray bottle dispensing apparatus by the insert; and a probe for selectively accessing one or more of the multiple reservoirs of the insert, the probe being connected to the barrel of the spray head.

Various embodiments of the probe include a second shaft portion connected to the disc portion, a third shaft portion connected to the disc portion and a fourth shaft portion connected to the disc portion.

A still further aspect of the invention is a rechargeable spray bottle dispensing apparatus, comprising a spray bottle including a first neck portion; a spray head releasably connected to the first neck portion; a downtube connected to the spray head; a probe tip releasably connected to the downtube; and an insert disposed in the first neck of the bottle.

Preferably, the probe tip is made of a stiffer material than a material of the downtube.

The main concept according to the present invention is to provide a rechargeable dispenser, in particular a spray bottle dispenser package having at least one supply of chemical to allow the spray bottle dispenser to be recharged at least one time. The chemical can be in the form of a gas, liquid, semi-solid or solid. Specifically, the chemical liquid can be a one phase mixture, a two phase mixture, a dispersion or any other chemical reagent preferably having fluid characteristics. The chemical semi-solid can be in the form of a slurry, paste, solid dispersed in a liquid that still exhibits some fluid type characteristics, and the solid can be in the form of a powder, granules, tablet or other solid material form.

The chemical is preferably a concentrated chemical that is readily diluted with a solvent, in particular plain water. Preferably, the chemical can be immediately diluted, however, a chemical substance that can go into solution over a 24 hour or longer period of time can potentially be suitable for some applications.

The preferred embodiments of the present invention involve associating at least one quantity of chemical with the spray bottle dispenser itself Specifically, the chemical is stored in some manner, and connected directly internally or externally to the spray bottle dispenser. However, the present invention is broader in scope to include packaging the chemical and spray bottle dispenser together (i.e., connected indirectly) to be marketed at the point-of-sale. In this embodiment of the invention, a consumer would purchase the package containing a supply of chemical and the spray bottle dispenser, separate at home the spray bottle dispenser that has been filled by the bottler from the package and store the chemical portion of the package separate from the spray bottle dispenser in the household. The user would then retrieve the stored chemical upon consuming the initial contents of the spray bottle dispenser for purposes of recharging the spray bottle dispenser. Alternatively, the spray bottle dispenser is packaged unfilled along with one or more chemical containing packages (e.g. inserts).

The preferred embodiments of the invention store the at least one quantity of chemical directly or indirectly inside or outside the spray bottle dispenser. In the case of an indirect connection to the spray bottle dispenser, a mechanical fastener such as a plastic strip connects an external chemical reservoir to the spray bottle dispenser. In the case of a direct connection, the chemical reservoir is directly connected internally or externally to the spray bottle dispenser. The most preferred embodiments store the at least one quantity of chemical inside the spray bottle dispenser, particularly the bottle portion, to fully contain any inadvertent spills or leakage of chemical through the life of the spray bottle dispenser. These most preferred embodiments provide substantial advantages for handling, recharging and protecting household items from contact with chemical, and most importantly to prevent accidental ingestion by children. This particular point is especially important due to the much greater potency of chemical concentrate versus diluted chemical reagents currently being sold by bottlers at point-of-sale.

The most preferred embodiments also utilize conventional spray bottle dispenser components including plastic bottles, plastic spray heads, and plastic downtubes. In order to promote products incorporating the present invention, it is particularly important to utilize the standard components that are readily available and relatively inexpensive due to the large quantities sold and consumed. Thus, an add-on chemical reservoir for storing the chemical is highly desirable.

The most preferred add-on type chemical reservoir is an insert received within the bottle portion of the spray bottle dispenser. This type of insert can be manufactured extremely cheaply in high volume while providing all the performance characteristics necessary for a safe and reliable product. Specifically, the insert can be made with one or more chambers or cells containing chemical that can be accessed in various ways. For example, the reservoir can be sealed with membranes that can be punctured with an instrument, in particular the tip of a bayonet or probe. Adding lines of weaknesses, thinning of walls and other means for locally weakening a portion of the chemical reservoir can be implemented for use in the present invention.

The insert according to the present invention can take on many different forms and configurations. A first preferred embodiment of the insert is defined by a cylinder having one or more chambers or cells disposed therein. The interior of the cylinder can be provided with one or more bisecting walls to define the chambers along the length thereof. A cylinder having one or more bisecting walls can be easily extruded or injection molded in plastic. The top and bottom of the one or more chambers of the insert are sealed by upper and lower sealing membranes and/or walls. The membranes can be a plastic molded cap (e.g. snap cap or welded) films, foils, composites of films and foils, or any other suitable composite that is both chemically resistant and subject to being punctured readily by an instrument, in particular, the tip of a probe. Preferably, the bottom of the insert is sealed by a molded wall portion formed integrally with the walls thereof to be leakproof and improve shelf life.

The upper and lower sealing membranes and/or wall portions can be connected to the insert by bonding, adhesive bonding, thermal bonding, sonic welding, or suitable methods for forming a liquid tight seal (e.g., hermetic seal).

This embodiment of the insert can be marketed inside an unfilled or filled spray bottle dispenser at point-of-sale. The downtube and a probe extend into through holes of the insert. The downtube extends down into the lower portion of the bottle portion to access premixed chemical reagent added by the bottler during manufacture. After consumption of the chemical reagent, a user unscrews the spray head and lifts the probe (attached to the spray head ) from the bottle portion. Either the spray head (with probe attached) or the insert is rotated so that a chemical reservoir is now positioned where the through hole for the probe was previously positioned (i.e., now registered for being punctured by the probe). The user then forces the tip of the probe through the upper sealing membrane and/or wall portion, down through the chamber, and then punctures the lower sealing membrane and/or wall portion. Water or other suitable diluent can be added through a second neck of the spray bottle. This configuration allows the chemical to be always stored within the confines of the spray bottle dispenser, and minimizes the steps needed for recharging the spray bottle dispenser. In one aspect of the invention, the probe simultaneously punctures more than one reservoir. In another aspect of the invention, the downtube is modified to function as the probe and a separate probe is not needed.

The consumer will experience little inconvenience in lifting the spray head and probe from the bottle portion, rotating either the insert or the spray head, puncturing the chemical reservoir with the probe, adding water through the second neck of the spray bottle before or after adding chemical, and reassembling the spray head portion to the bottle portion. Further, the chemical concentrate stored within the insert is extremely safe for handling and preventing accidental consumption by children (i.e., a child would have to successfully unscrew the spray head portion from the bottle portion, fully remove the probe from the bottle portion, and successfully puncture the insert). Further, even in the event of puncture of the insert by a child, the access opening through the upper sealing membrane would be sufficiently small to substantially limit spilling and preventing the chemical concentrate from being easily ingested by a child. Thus, the present invention provides substantial safeguards over current methods of selling large quantities of chemical concentrate at the point-of-sale, and subsequently having the consumer handle and mix the chemical concentrate in his or her home.

The insert can have one, two, three, four or more separate chambers or cells. The four cell configuration allows the user to initially consume the optional premixed diluted chemical reagent of the spray bottle dispenser, and then recharge the spray bottle dispenser four more times prior to consuming all the chemical contained in the spray bottle dispenser. If the consumer then disposed of the spray bottle dispenser at that point, this would provide at least a four time improvement over the current practice of consumers utilizing a spray bottle dispenser one time prior to disposal. Thus, the consumption of spray bottle dispensers could be reduced four-fold (i.e., one fifth the waste) if fully implemented. The insert can be configured to be removable or non-removable after being inserted in the spray bottle dispenser. The removable insert embodiment would allow a spray bottle dispenser to be used potentially hundreds of times by replacing spent inserts thereby reducing the waste of spray bottle dispensers by ninety percent (90%) or greater.

However, this invention can provide for an even greater improvement over the current practices by consumers. Specifically, the insert and a probe can also be sold at the point-of-sale as a separate item that could be added to a conventional point-of-sale type spray bottle dispenser having no inserts, after the initial consumption of the contents. Or, only the insert can be sold at the point-of-sale as a separate item for use with spray bottle dispensers having inserts and a probe according to the present invention, after the complete chemical consumption of all the reservoirs of the insert initially sold with the unit.

The invention greatly decreases the shipping weight and costs associated therewith, decreases retail shelf space for marketing the product, and most importantly greatly decreases the consumption and waste of plastic material. Specifically, the weight of plastic needed to make the four chamber insert described above is a small fraction compared with the weight of four conventional spray bottle dispensers based on equal amounts of useable diluted chemical reagent.

Further, conventional spray bottle dispensers are substantially greater in cost to produce compared to the insert according to the present invention. Thus, the present invention conserves significant labor and other direct and indirect costs associated with the production of conventional spray bottle dispenser components. Furthermore, the insert according to the present invention can readily be recycled, and could potentially be refilled if an adequate system were developed to reprocess such inserts, however, more than likely the inserts would be disposed of by consumers based on convenience factors.

Further objects, features and advantages of the invention will become apparent from the following detailed description, taken in conjunction with the accompanying drawing.

BRIEF DESCRIPTION OF THE DRAWINGS

FIG. 7 is an elevation view of a first embodiment of a probe according to the present invention.

FIG. 8 is a top view of the probe of FIG. 7.

FIG. 9 is a bottom view of the probe of FIG. 7.

FIG. 10 is a partial cross-section of the probe of FIG. 7 installed in one embodiment of a spray head.

FIG. 11 is a bottom view of the shaft portion of the probe of FIG. 7.

FIG. 12 is a partial cross-section of a second embodiment of a probe and spray head according to the present invention.

FIG. 13 is a top view of the embodiment of the probe shown in FIG. 12.

FIG. 14 is a partial cross-section of a third embodiment of a probe and spray head according to the present invention.

FIG. 15 is a top view of the embodiment of the probe shown in FIG. 14.

FIG. 16 is a partial cross-section of an adapter and spray bottle according to the present invention.

FIG. 17 is a top view of the adapter of FIG. 16.

FIG. 18 shows a diluent filter insert according to the present invention, with an elevation view of the diluent filter container and a top view of the diluent filter cover.

FIG. 19 is a partial cross-section of the diluent filter insert of FIG. 18 inserted in the neck of a spray bottle.

FIG. 25 is an exploded view of a spray bottle dispenser with another embodiment of a probe according to the present invention.

FIGS. 26(*a*) and (*b*) are fragmentary cross-sections of the probe of FIG. 25.

FIG. 27 is a cross-section of the insert of FIG. 25.

DETAILED DESCRIPTION OF THE PREFERRED EMBODIMENTS

Figure 1:
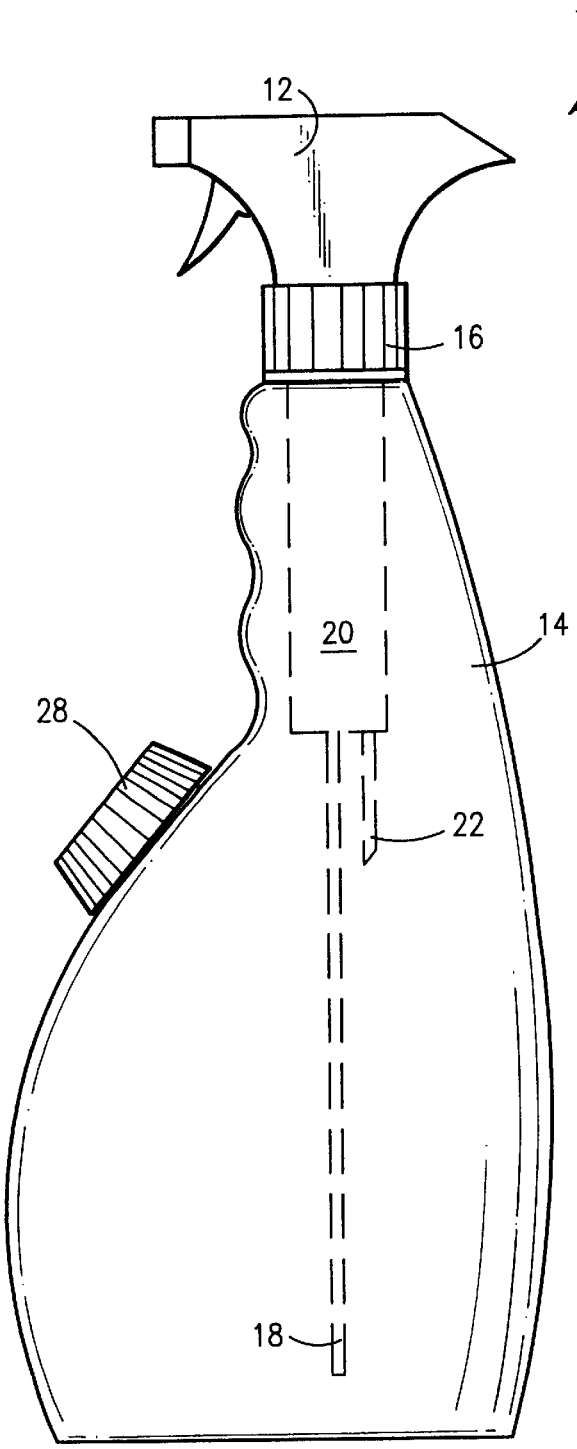
FIG. 1 is an elevation view of an embodiment of a spray bottle dispenser according to the present invention.
Figure 2:
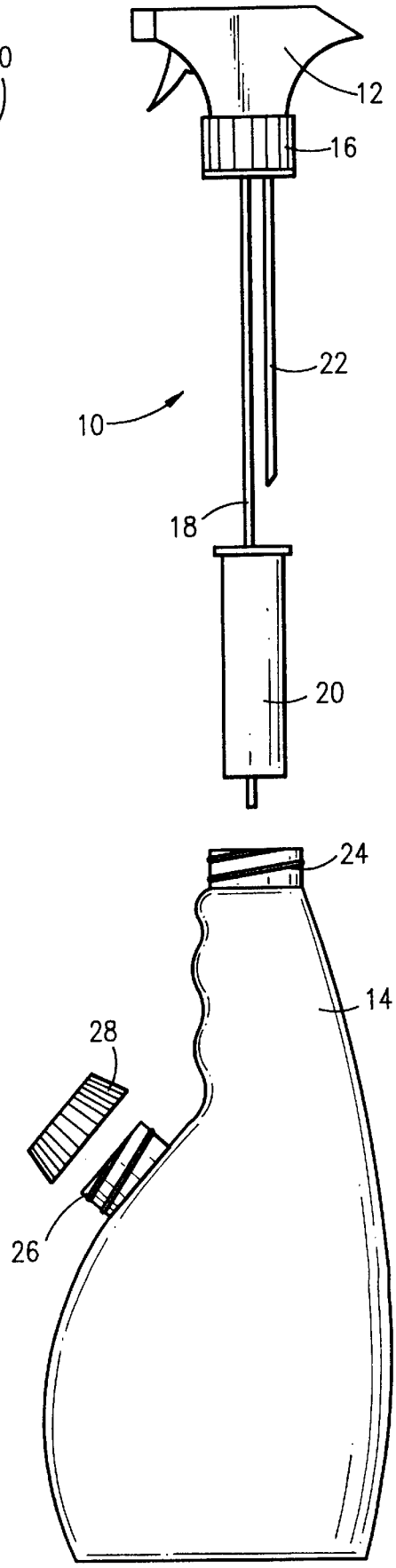
FIG. 2 is an exploded view of the spray bottle dispenser of FIG. 1.

A preferred spray bottle dispenser 10 is shown in FIGS. 1 and 2. The spray bottle dispenser 10 includes a spray head 12, a downtube 18 and an internally threaded coupler 16. The spray bottle dispenser 10 also includes a two-neck spray bottle 14 including a first externally threaded neck portion 24 cooperating with the internally threaded coupler 16 of the spray head 12, and a second externally threaded neck portion 26 cooperating with an internally threaded cap 28.

Figure 3:
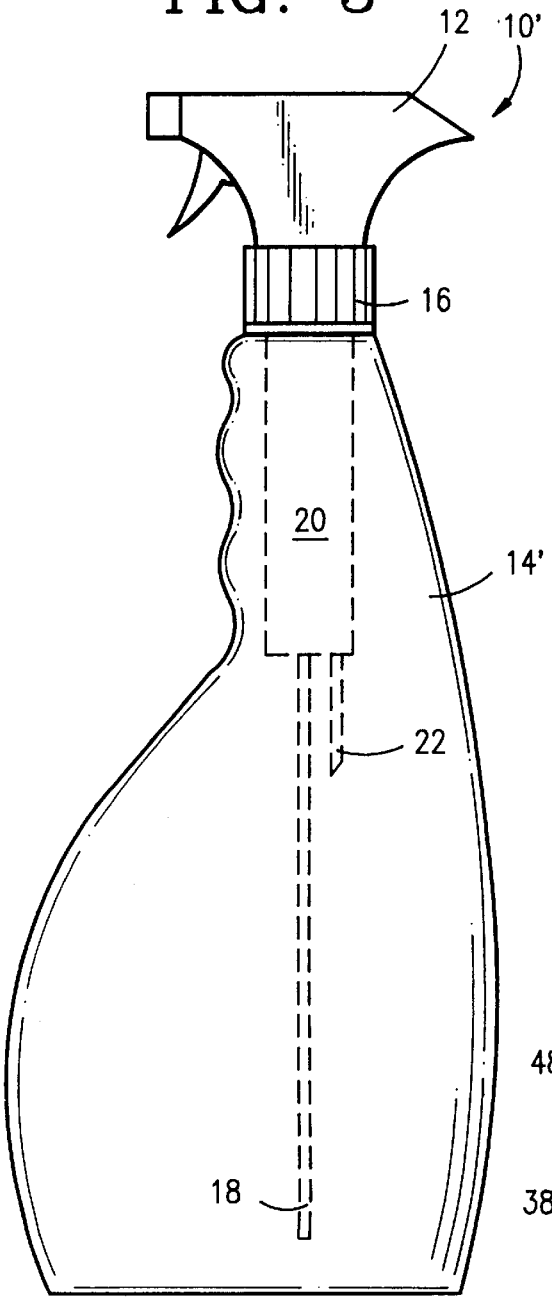
FIG. 3 is an elevation view of another embodiment of a spray bottle dispenser according to the present invention.

Another embodiment of a spray bottle dispenser 10' is shown in FIG. 3. The spray bottle dispenser 10' is the same as the spray bottle dispenser 10 except it includes a one-neck spray bottle 14' rather than a two-neck bottle 14.

An insert 20 is disposed within the assembled spray bottle dispenser 10, as shown in FIG. 1. The insert 20 includes at least one reservoir for containing chemical concentrate, preferably, the insert includes multiple reservoirs containing chemical concentrate. A probe 22 is connected to the spray head 12. The insert 20 is provided with a through hole for accommodating the downtube 18.

The spray bottle dispenser 10 is assembled by connecting the probe 22 and downtube 18 to the spray head 12, and then sliding the insert 20 onto the probe 22 and downtube 18. This subassembly shown in FIG. 2, is then loaded into the spray bottle 14 through the first neck portion 24. Alternatively, the insert 20 can be first disposed in the first neck portion 24 of the spray bottle 14 and then the subassembly including the spray head 12, downtube 18, and probe 22 may be loaded into the spray bottle 14 by feeding the tips of the downtube 18 and the probe 22 through the through holes in the insert 20. Then, the threaded coupler 16 of the spray head 12 is rotated to connect with the externally threaded first neck portion 24 of the spray bottle 14. The cap 28 can be connected to the externally threaded second neck portion 26 before or after the subassembly is connected to the spray bottle 14. The connection between the probe 22 and the spray head 12 may take several forms, as discussed in more detail hereinafter.

The above-described assembly of the spray bottle dispenser 10 is substantially the same for the one neck spray bottle 10' shown in FIG. 3.

Figure 4:
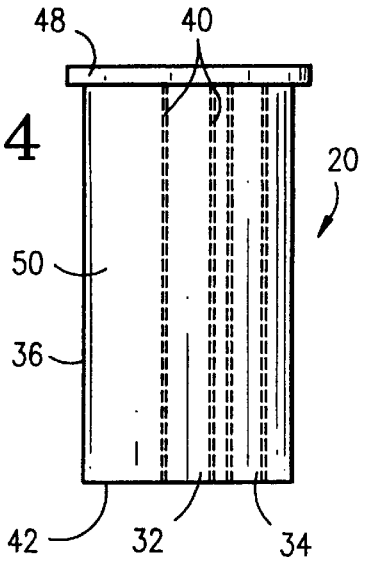
FIG. 4 is an elevation view of an insert according to the present invention.
Figure 5:
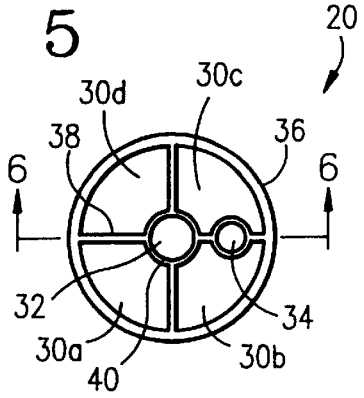
FIG. 5 is a top view of the insert of FIG. 4.
Figure 6:
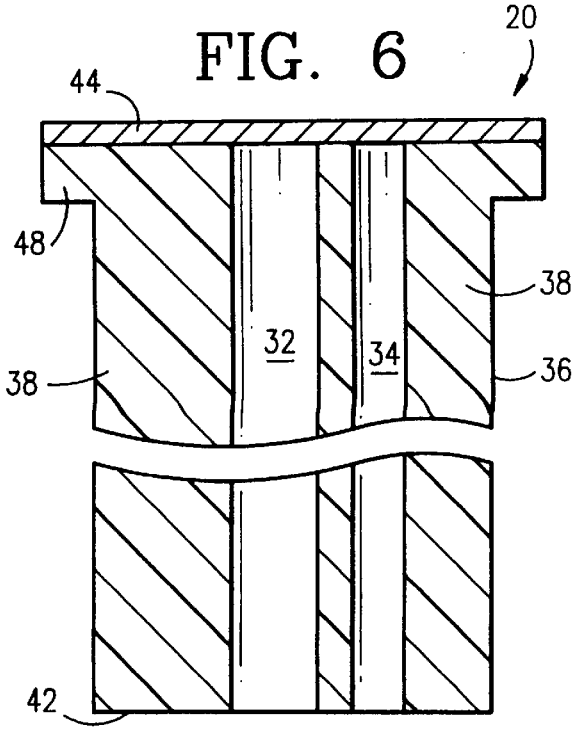
FIG. 6 is a partial cross-section of the insert of FIG. 5 taken along the line 6—6.

The details of a preferred embodiment of the insert 20 are shown in FIGS. 4–6. The insert is provided with four (4) reservoirs 30*a*, 30*b*, 30*c*, 30*d*. The reservoirs are created by the ribs 38. The insert 20 is provided with a through hole 32 to accommodate the downtube 18 of the spray head 12 and a through hole 34 for accommodating and storing the probe 22 when the spray dispensing apparatus 10 is assembled.

The reservoirs 30*a*, 30*b*, 30*c*, 30*d*, are defined by different wall portions of the insert 20. Specifically, the insert 20 includes an outer cylindrical portion 36 divided into four (4) sections by ribs 38 connecting to an inner cylindrical portion 40. The upper ends of the reservoirs 30*a*, 30*b*, 30*c*, 30*d* are open while the lower ends of the reservoirs are closed by a bottom wall portion 42, as shown in FIG. 4. The insert 20 is preferably made by injection molding a plastic material (e.g., polyethylene, high density polyethylene, polypropylene, polyvinyl chloride, PETE, etc.).

The upper ends of the reservoirs 30*a*, 30*b*, 30*c*, 30*d* are sealed by a sealing membrane 44, as shown in FIG. 6. The membrane, for example, can be a metal foil, polymer film, composite polymer film, composite film of foils and/or films, or other suitable sealing membranes. The membrane 44 can be applied by adhesive, thermal welding, inductive welding, ultrasonic welding, or other suitable methods. It has been found that the use of a cap type seal is particularly suitable utilizing thermal and/or inductive heating or welding to ensure a long lasting airtight seal. Alternatively, a foil and/or film itself can be thermally and/or inductively heated and sealed without a backing layer of a cap type seal.

The bottom of each reservoir 30*a*, 30*b*, 30*c*, 30*d* is formed closed, and is defined by bottom wall portion 42 integrally molded as part of the insert 20, as shown in FIG. 6. The bottom wall 42 is configured so as to be breakable by the tip of the probe 22. In a most preferred embodiment, the bottom wall is molded as a thin wall, for example, 0.010 to 0.018 inches thick. The rupturing of the bottom wall portion 42 of one of the reservoirs 30*a*, 30*b*, 30*c*, 30*d*, releases chemical concentrate stored in that particular reservoir of the insert 20 into the spray bottle 14.

In another embodiment (not shown), a circular groove may be molded in the bottom wall portion 42. The circular groove reduces the thickness of the bottom wall portion 42 between the outer cylindrical wall portion 36 and inner cylindrical wall portion 40. In one embodiment, the circular groove may be located approximately midpoint between the outer cylindrical wall portion 36 and inner cylindrical wall portion 40, which corresponds to a position where the tip of the probe 22 engages during a process of rupturing or puncturing the bottom wall portion 42 of one of the reservoirs 30*a*, 30*b*, 30*c*, 30*d*. The probe can be designed to pierce (e.g. sharpened tip) or shear (e.g. flat bottomed tip) to compromise the bottom wall portion 42.

The insert 20 shown in FIG. 4 is provided with an upper flange portion 48 to allow the insert 20 to be suspended in the first neck portion 24 of the spray bottle 14. The body portion 50 is provided with an outer diameter such that it can be inserted within the first neck portion 24 of the spray bottle 14. Specifically, the outer diameter of the body portion 50 can be slightly oversized, the same size, or undersized relative to the inner diameter of the circular opening of the first neck portion 24. In the situation of the diameter of the insert 20 being slightly oversized, an interference fit is provided to retain the insert 20 within the first neck portion 24 to an extent requiring some force to be applied to the insert in order to retrieve the insert 20 from the first neck portion 24 at a later time. Alternatively, in the situation of the outer diameter of the insert 20 being the same or undersized relative to the inner diameter of the first neck portion 24, the insert 20 can be freely inserted and removed with little or no resistance. In some applications, it is desirable that the insert 20 is freely insertable and removable to allow another insert to be reloaded into the first neck portion 24 of the spray bottle 14 to maximize reuse of the spray bottle dispenser 10. In other applications, it is desirable that the insert, once inserted into the first neck portion 24 of the spray bottle 14, is substantially not removable thereby precluding reuse of the spray bottle dispenser 10 (e.g., chemical concentrate that is highly toxic or corrosive such as insecticides, strongly acidic, strongly basic, organic solvents, toxic additives).

A first embodiment of the probe 22 is shown in FIGS. 7–11. In general, the probe 22 is made as a one-piece unit, for example, by injection molding of plastic material (e.g. polyethylene, high density polyethylene, polypropylene, polyvinyl chloride, PETE, polysulfone, etc.). As best seen in FIG. 7, the probe 22 includes a connecting portion 56 for attaching the probe 22 to the spray head 12 and a disc portion 58. The connecting portion 56 and the disc portion 58 define a through hole 60 for the downtube 18. The probe 22 further includes a shaft portion 62 connected to the disc portion 58 at one end and defining a tip 64 at the other end.

FIG. 10 is a partial cross-section of the first embodiment of the probe 22 installed in a spray head 12*a*, which is one of several commercially available types of spray heads. FIG. 10 shows the connection between the spray head 12*a* and the probe 22. The upper portion of the spray head 12*a* and the lower portion of the downtube 18 and shaft portion 62 of the probe have been omitted in FIG. 10. The same portions of the spray heads and probes have been omitted in FIGS. 12 and 14, which show cross-sections of other embodiments of the probe.

As shown in FIG. 10, the spray head 12*a* includes a movable tubular piston 54 and a barrel or nozzle 52. The downtube 18 fits inside the movable piston 54. The connecting portion 56 of the probe 22 includes a first cylindrical portion 66 inserted into the barrel 52 to form a non-locking press fit with the interior surface of the barrel 52. The connecting portion 56 further includes a second cylindrical portion 68 having an outside diameter larger than the outside diameter of the first cylindrical portion 66. The larger outside diameter of the second cylindrical portion 68 forms a stop 70 against the barrel 52 which limits the distance the probe 22 may be inserted into the spray head 12*a*.

The non-locking press fit that the first cylindrical portion 66 makes with the interior surface of the barrel 52 is an important feature of the probe 22. With the non-locking press fit, the force required to rotate the probe 22 within the barrel 52 is significantly less than the force required to pull the probe 22 off of the barrel 52. This difference in rotational force and "pull-off" force makes the probe 22 particularly advantageous.

For example, when the probe 22 is removed from the through hole 32 in the insert 20 to initially puncture one of the reservoirs 30*a*–30*d* in the insert 20, the spray head 12*a* with probe 22 attached is rotated so that the probe 22 is above one of the reservoirs 30*a*–30*d* selected to be punctured. After the reservoir is punctured by the probe, the spray head is reattached to the bottle portion 14 using the inner threaded coupler 16. Because the spray head 12*a* has been rotated, it will not be in the proper position for use relative to the bottle portion 14. However, one can simply rotate the spray head to the proper position, and, because the probe 22 rotates on the barrel 52, the probe will remain in its position in the punctured reservoir without being bent by the rotation of the spray head 12*a*. Similarly, when the probe 22 is removed from one of the punctured reservoirs 30*a*–30*d* to a new unpunctured reservoir, the spray head 12*a* can be rotated to the proper operating position while the probe 22 remains stationary in the newly punctured reservoir. This configuration allows the multiple reservoirs to be selectively accessed to provide multiple recharging of the spray bottle dispenser.

Another advantageous feature of the embodiment of the probe shown in FIGS. 7–11 relates to the torque applied to the probe by the spray head when the spray head is rotated. In the assembly shown in FIG. 10, the torque applied by the spray head 12*a* to the probe 22 tends to force the probe 22 upward into the spray head 12*a*, thereby insuring a good connection between the first cylindrical portion 66 and the interior surface of the barrel 52. The longitudinal dimension of the first cylindrical portion 66 from the stop 70 to the upper end of the probe 22 should be of sufficient length to allow the probe 22 to be displaced downward somewhat from the fully inserted position of FIG. 10 without being completely disengaged from the barrel 52. In a preferred embodiment, this longitudinal dimension of the first cylindrical portion 66 is about 0.22 inches.

The disc portion 58 may include a stiffener ring 61 as shown in FIGS. 7 and 9. The stiffener ring 61 is attached to or molded integrally with the underside of the disc portion 58. The stiffener ring 61 provides extra strength for the disc portion 58. In a preferred embodiment, an outside diameter of the disc portion 58 is larger than an outside diameter of the stiffener ring 61. However, the outside diameters could be the same.

It is also preferable that the outside diameter of the disc portion 58 is smaller than the inside diameter of the inner threaded coupler 16 of the spray head portion 12. Of course, the outside diameter of the disc portion 58 cannot be larger than the inside diameter of the inner threaded coupler 16 because the disc portion 58 must fit inside the coupler 16. However, it is advantageous that the outside diameter of the disc portion 58 be somewhat smaller than the inside diameter of the coupler 16 so that the washer (usually having a layer of foam-like material) inside the coupler 16 can make an effective seal against the bottle 14 or 14' when the coupler 16 is tightened. A preferred outside diameter for the disc portion 58 is about 0.81 inches.

As shown in FIGS. 8 and 9, two ribs 63 extend from the inside of the stiffener ring 61 to the through hole 60. The ribs 63 are disposed on opposite sides of the shaft portion 62. The ribs 63 provide support to the disc portion 58 in the area of the shaft portion 62. The shaft portion of the disc portion 58 is stressed as force is applied to the shaft so that it punctures either the top or bottom of a reservoir 30*a*–30*d*. The ribs 63 help maintain the stability of the disc and shaft portions under stress. The ribs 63 also provide an advantageous location for pushing the probe out of the mold. Because the shaft portion 62 is a relatively long and thin member, it could be easily bent or broken off when removed from the mold. The ribs 63 provide a place for the mold push pins to push the disc portion 58 and attached shaft portion 62 out of the mold, thereby reducing stress on the shaft portion 62.

As shown in FIGS. 7 and 11, the shaft portion 62 is provided with a tip portion 64 having a beveled end that is somewhat sharpened to facilitate rupturing of the bottom wall portion of a reservoir of the insert 20. Specifically, the sharpened tip provides a point force to facilitate rupturing of the bottom wall portion 42 of the insert 20. The shaft portion 62 also includes a groove 72 formed therein. The groove 72 helps facilitate drainage of the chemical concentrate from a punctured reservoir 30*a*–30*d* to the bottle portion 14. To perform the drainage function, the groove 72 must extend from the punctured reservoir through the bottom wall of the insert 20 to the bottle portion 14. Preferably, the groove 72 so extends when the spray head 12*a* has been reattached via the coupler 16 to the bottle portion 14. Then, the chemical concentrate may continue to drain after the spray bottle dispenser 10 is reassembled. In a preferred embodiment, the groove 72 extends to the tip end 64 of the shaft portion 62. To aid in visually checking whether or not the chemical concentrate is draining from the punctured reservoir, the groove 72 is preferably located on a side of the shaft portion 62 facing away from the connecting portion 56, as shown in FIG. 7.

A particularly advantageous shape of the groove 72 is shown in FIG. 11, which is a bottom view of the shaft portion 62. As shown in FIG. 11, the groove 72 is defined by a substantially flat portion 74, concave portions 76 at each end of the substantially flat portion 74, and convex portions 78 adjacent the concave portions 76. The convex portions 78 then blend into the circumference 80 of the shaft portion 62. The shape of the groove 72 shown in FIG. 11 has been found to help prevent the bottom wall 42 of the insert 20 from sealing around the shaft portion 62 of the probe 22 when the probe punctures a reservoir. If the bottom wall 42 were to seal around the shaft portion 62 of the probe, then the chemical concentrate would not drain out of the reservoir into the bottle portion 14 of the spray bottle dispenser 10. Other shapes of the groove 72 are also possible.

FIG. 12 is a cross-sectional, fragmentary view of a second embodiment of a probe 22' and spray head 12*b*. FIG. 13 is a top view of the probe 22'. The spray head 12*b* includes a barrel or nozzle 52'. The probe 22' includes a connecting portion 56', a disc portion 58' and a shaft portion 62'. A downtube 18 fits inside the barrel 52'. The probe 22' includes a through hole 60' for accommodating the downtube 18. The probe 22' is connected to the barrel 52' by the connecting portion 56'. Specifically, the interior surface of the connecting portion 56' forms a non-locking press fit with the exterior surface of the barrel 52'.

The non-locking press fit of the connecting portion 56' and the barrel 52' has the same advantage as the non-locking press fit of the connecting portion 56 and the barrel 52 of the first embodiment of the probe 22, namely, the force required to rotate the probe 22' around the barrel 52' is significantly less than the force required to pull the probe 22' off of the barrel 52'. Thus, when the probe 22' is removed from the through hole 32 in the insert 20 to initially puncture one of the reservoirs 30*a*–30*d* in the insert 20, or when the probe 22' is removed from one of the punctured reservoirs 30*a*–30*d* to a new unpunctured reservoir, the spray head 12*b* can be rotated to the proper operating position while the probe 22' remains stationary in the newly punctured reservoir.

Although not shown in FIGS. 12 and 13, the probe 22' may include a stiffener ring and ribs similar to the stiffener ring 61 and ribs 63 of the first embodiment of the probe 22. Additionally, the shaft portion 62' may include the detailed features of the shaft portion 62 of the first embodiment of the probe 22. Like the first embodiment of the probe 22, an advantageous feature of the second embodiment of the probe 22' relates to the torque applied to the probe 22' by the spray head when the spray head is rotated. In the assembly shown in FIG. 12, the torque applied by the spray head 12*b* to the probe 22' tends to force the probe 22' upward into the spray head 12*b*, thereby insuring a good connection between the connecting portion 56' and the interior surface of the barrel 52'. The longitudinal dimension of the connecting portion 56' should be of sufficient length to allow the probe 22' to be displaced downwardly somewhat without being completely disengaged from the barrel 52'.

FIG. 14 is a cross-sectional, fragmentary view of a third embodiment of a probe 22" and spray head 12*c*. FIG. 15 is a top view of the probe 22'. The spray head 12*c* includes a barrel or nozzle 52". The probe 22" includes a connecting portion 56", a disc portion 58", a shaft portion 62" and a generally cylindrical downtube insertion portion 82. The probe 22" includes a through hole 60". A downtube 18 fits inside the generally cylindrical downtube insertion portion 82. The probe 22" is connected to the barrel 52" by the connecting portion 56". Specifically, the exterior surface of the connecting portion 56" forms a non-locking press fit with the interior surface of the barrel 52".

The non-locking press fit of the connecting portion 56" and the barrel 52" has a similar advantage as the non-locking press fits of the connecting portions 56, 56' and the barrels 52, 52' of the first and second embodiments of the probe 22, 22' discussed above. Namely, the force required to rotate the probe 22" inside the barrel 52" is significantly less than the force required to pull the probe 22" out of the barrel 52". Thus, when the probe 22" is removed from the through hole 32 in the insert 20 to initially puncture one of the reservoirs 30*a*–30*d* in the insert 20, or when the probe 22" is removed from one of the punctured reservoirs 30*a*–30*d* to a new unpunctured reservoir, the spray head 12*c* can be rotated to the proper operating position while the probe 22" remains stationary in the newly punctured reservoir.

Although not shown in FIGS. 14 and 15, the probe 22" may include a stiffener ring and ribs similar to the stiffener ring 61 and ribs 63 of the first embodiment of the probe 22. Additionally, the shaft portion 62" may include the detailed features of the shaft portion 62 of the first embodiment of the probe 22. The longitudinal dimension of the connecting portion 56" should be of sufficient length to allow the probe 22" to be displaced downwardly somewhat without being completely disengaged from the barrel 52".

In one aspect of the invention, an adapter 88 is provided between a bottle 84 (e.g. wide mouth container) and a cap or spray head, as shown in FIGS. 16 and 17. The adapter 88 is provided with a smaller neck portion 92 having external threads 100 and a larger neck portion 90 having internal threads 98. The smaller neck portion 92 is for connecting to the coupler of a conventionally sized spray head (e.g. 28 millimeter). The larger neck portion 90 is for connecting to the externally threaded neck portion 86 of a bottle 84. An insert 94 is inserted in the bottle 84. The insert 94 is similar in construction and function to the insert 20 of FIGS. 1–6, but is made larger to fit the larger bottle 84. The insert 94 operates in the manner of the insert 20.

FIGS. 18 and 19 show an insert 102 which functions to filter diluent, for example, water, added to the spray bottle 14. The diluent filter insert 102 includes a cover 104 and a generally cylindrical container 106. The insert 102 is made of a plastic material. The cover 104 has a molded plastic mesh bottom 108 and the container 106 has a molded plastic mesh bottom 110. The mesh bottoms 108 and 110 allow diluent to pass freely.

The container 106 includes a means for filtering diluent added to the bottle 14. The means for filtering may include, for example, activated charcoal, diatomaceous earth and filtering cloth. In a preferred embodiment, the means for filtering comprises a first layer of activated charcoal 112, a second layer of filtering material such as diatomaceous earth 114 and a third layer of filtering cloth 116. The cover 104 press fits into the top of the container 106, over the layer of filtering cloth 116. A flange 118 supports the filter insert 102 in the bottle 14.

In a two-neck bottle, such as bottle 14 in FIGS. 1 and 2, the diluent filter insert 102 is placed in the second neck portion 26 having external threads. The internally threaded cap 28 seals the second neck portion 26. When adding diluent to the bottle 14, the cap 28 is removed and the diluent is poured into the second neck portion 26 through the diluent filter insert 102. The filter insert 102 removes impurities from the added diluent so that the mixture of chemical concentrate and diluent functions better.

It is also possible to use the diluent filter insert 102 in a single neck bottle, for example, bottle 14' shown in FIG. 3. In that case, it would be necessary to remove the spray head-probe-insert 20 subassembly and replace it with the filter insert 102. After the diluent is added, the filter insert 102 would be removed and replaced with the spray head-probe-insert 20 subassembly. The preferred use of the diluent filter insert 102 is in a two-neck bottle.

The first embodiment of the probe 22 shown in FIGS. 7–11, the second embodiment of the probe 22' shown in FIGS. 12 and 13 and the third embodiment of the probe 22" shown in FIGS. 14 and 15 have been shown and described as having a single shaft portion 62, 62' and 62", respectively. However, the probe may also have more than one (multiple) shaft portion. With a probe having multiple shaft portions, multiple reservoirs in the insert may be simultaneously punctured. It may be desirable to simultaneously puncture more than one reservoir when the reservoirs contain different chemicals that must be combined to form the desired final product. It may also be desirable to simultaneously puncture more than one reservoir when the reservoirs contain the same chemical but different strengths of the final product are needed for different applications of the product.

Figure 20A:
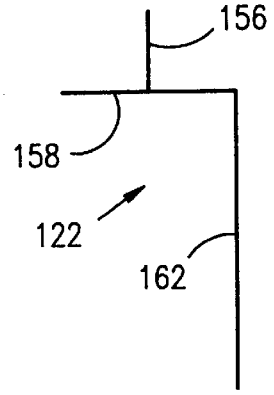
FIGS. 20(*a*) and (*b*) schematically show a probe with one shaft portion.
Figure 20B:
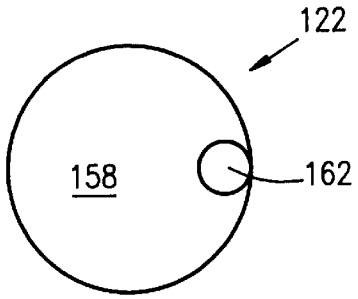

FIGS. 20(*a*) and (*b*) schematically represent a probe 122 which can have the features of any of the probes 22, 22' and 22". FIG. 20(*a*) is a schematic elevation view and FIG. 20(*b*) is a schematic bottom view of the probe 122. The probe 122 includes a connecting portion 156, a disc portion 158 and a shaft portion 162. It should be understood that the probe 122 can include features of the above-described probes 22, 22' and 22". For example, in the case of the probe 22, the probe 122 may include the first and second cylindrical portions, a stiffener ring, and ribs extending from the stiffener ring to the through hole.

Figure 22A:
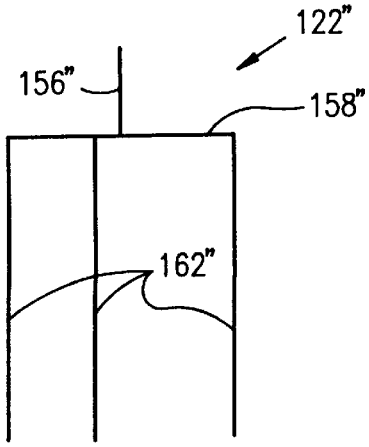
FIGS. 22(*a*) and (*b*) schematically show a probe with three shaft portions.
Figure 21A:
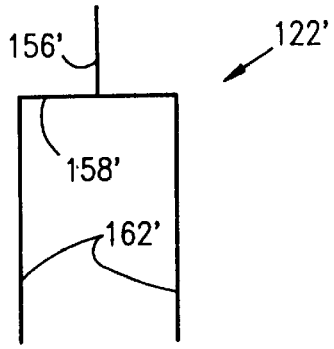
FIGS. 21(*a*)–(*c*) schematically show a probe with two shaft portions.
Figure 21B:
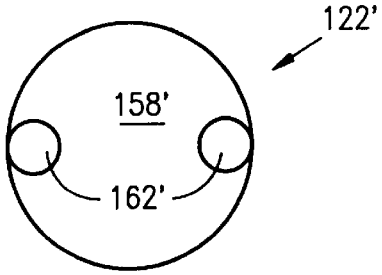
Figure 21C:
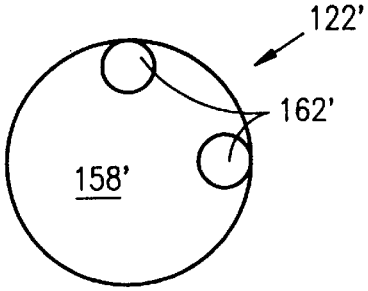
Figure 22B:
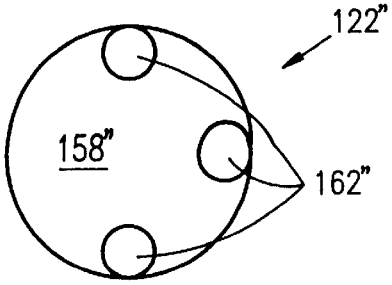
Figure 23A:
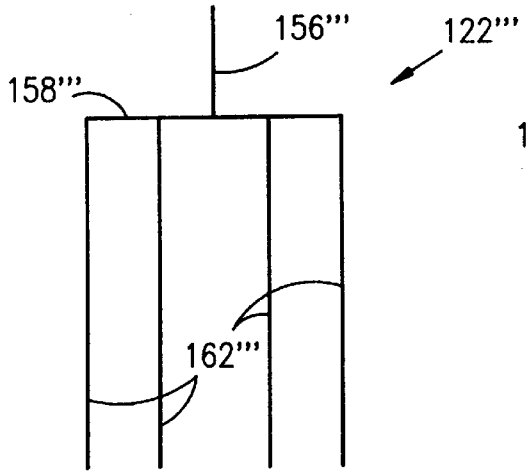
FIGS. 23(*a*) and (*b*) schematically show a probe with four shaft portions.
Figure 23B:
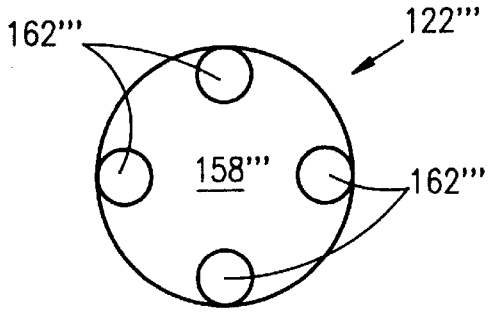
Figure 24A:
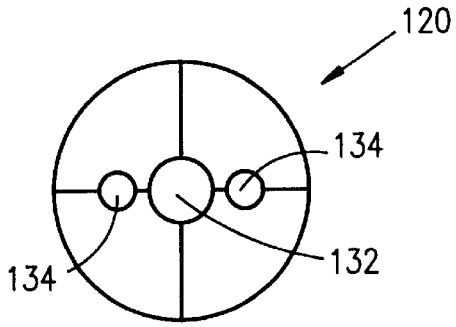
FIGS. 24(*a*)–(*d*) schematically show inserts having multiple through holes for use with probes having multiple shaft portions.
Figure 24B:
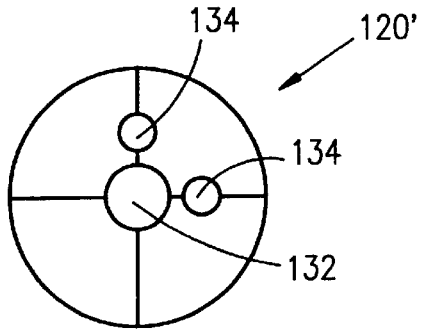
Figure 24C:
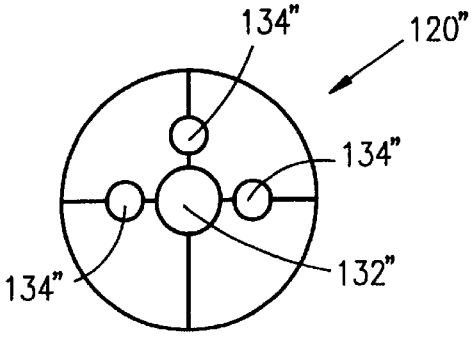
Figure 24D:
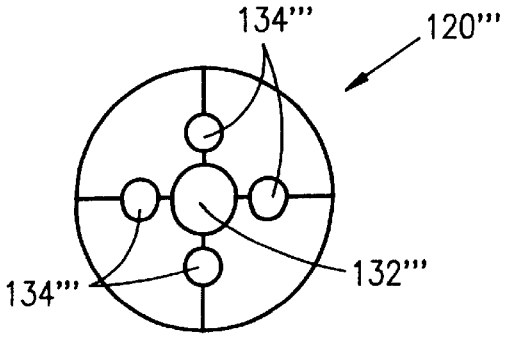

FIGS. 21–23 schematically represent variations of the probe 122 wherein additional shaft portions have been added. It should be understood that the additional shaft portions may include the features of the shaft portion 62 such as the groove 72, a sharpened and/or beveled tip, and various geometries of the groove 72.

FIG. 21 (*a*) shows a probe 122' having a connecting portion 156', a disc portion 158' and two shaft portions 162'. The shaft portions 162' may be located on the disc portion 158' at various locations with respect to each other. For example, FIG. 21(*b*) shows a bottom view of a most preferred embodiment of the probe 122' with the shaft portions 162' located about 180 degrees apart. FIG. 21(*c*) shows a bottom view of a preferred embodiment of the probe 122' with the shaft portions 162' located about 90 degrees apart.

FIG. 22(*a*) shows a probe 122" having a connecting portion 156", a disc portion 158" and three shaft portions 162". The shaft portions 162" may be located on the disc portion 158" at various locations with respect to each other. For example, FIG. 22(*b*) shows a bottom view of a most preferred embodiment of the probe 122" with the shaft portions 162" located about 90 degrees apart. FIG. 23(*a*) shows a probe 122'" having a connecting portion 156'", a disc portion 158'" and four shaft portions 162'". The shaft portions 162'" may be located on the disc portion 158'" at various locations with respect to each other. For example, FIG. 23(*b*) shows a bottom view of a most preferred embodiment of the probe 122'" with the shaft portions 162'" located about 90 degrees apart.

Referring now to FIGS. 4 and 5, the insert 20 used with the probes 22, 22' and 22" includes a through hole 32 for the downtube 18 and a through hole 34 for the single shaft portion 62, 62' and 62", respectively. When using the embodiments of the probe having multiple shaft portions, the insert 20 must be modified to include additional through holes for the additional shaft portions. FIGS. 24(*a*)–(*d*) schematically show top views of inserts having additional through holes for additional shaft portions.

FIG. 24(*a*) shows a preferred embodiment of an insert 120 having a through hole 132 for a downtube and two through holes 134 for the two shaft portions 162' of the probe shown in FIG. 21(*b*). FIG. 24(*b*) shows an insert 120' having a through hole 132' for a downtube and two through holes 134' for the two shaft portions 162' of the probe shown in FIG. 21(*c*). FIG. 24(*c*) shows an insert 120" having a through hole 132" for a downtube and three through holes 134" for the three shaft portions 162" of the probe shown in FIG. 22(*b*). FIG. 24(*d*) shows an insert 120'" having a through hole 132'" for a downtube and four through holes 134'" for the four shaft portions 162'" of the probe shown in FIG. 23(*b*).

The probes with multiple shaft portions and the corresponding inserts cooperate with the spray bottles and spray heads in the same way as the probes having a single shaft portion. Of course, more force must be applied to the probe when puncturing more than one reservoir at a time.

A further embodiment of a probe according to the present invention is shown in FIGS. 25–27. FIG. 25 is an exploded view of a spray bottle dispensing apparatus 210 including a spray head 212, a downtube 218, a probe tip 222, an insert 220 and a bottle 214. The spray head 212 includes an internally threaded closure 216 that cooperates with the externally threaded neck portion 215 of the spray bottle 214. The spray head 212, downtube 218 and bottle 214 may all be conventionally produced items that comprise a conventional spray bottle dispensing apparatus for dispensing, for example, cleansers, detergents, etc. The probe tip 222 and insert 220 are added to the conventional spray bottle dispenser to convert it to a rechargeable spray bottle dispenser. The bottle 214 may also be a two neck bottle, as shown in FIGS. 1 and 2.

The probe tip 222 is inserted in the end of the downtube 218 and held there by, for example, a friction or interference fit. FIG. 26 shows a probe tip 222 inserted in the downtube 218. A stepped portion 226 of the probe tip provides a seat for the downtube 218 against the probe tip 222. Preferably, the end of the probe tip is sharpened as at 228.

A conventional downtube 218 is generally made of high density polyethylene (e.g. 0.94–0.96 g/cc) or polypropylene. The conventional downtube 218 is not a preferred device for puncturing the insert 220 because the downtube 218 generally buckles and/or deforms under the application of force in the longitudinal direction. The probe tip 222 is made of, for example, glass-filled polypropylene, polysulfone, stainless steel, etc. The amount of glass in the glass-filled polypropylene is desirably in the range of 10–40%, more preferably 20–35% and most preferably 30%. Thus, the probe tip 222 is stiffer than the conventional downtube 218. The combination of the probe tip 222 and the downtube 218 is sufficiently strong to puncture the insert 220, thereby releasing the contents of the insert 220 into the bottle 214.

In a preferred embodiment, as shown in FIG. 27, the insert 220 includes a generally cylindrical body 230, a bottom 232 integrally molded with the generally cylindrical body 230 and a radially extending flange 234 at a top of the insert 220 for supporting the insert in the bottle 214. The insert defines a single reservoir 238 for containing, for example, a chemical concentrate. Preferably, the insert is made of a high density polyethylene. The top of the insert 220 is sealed by a membrane 236 made of, for example, a film, a foil, a composite of film and foil, or any other suitable composite that is both chemically resistant and subject to being readily punctured.

While the invention has been described with reference to certain preferred embodiments, numerous changes, alterations and modifications to the described embodiments are possible without departing from the spirit and scope of the invention, as defined in the appended claims and equivalents thereof.

What is claimed is:

1. An apparatus for use with rechargeable dispensers, comprising:

a spray head provided with a barrel, said spray head including a downtube and a probe connected to said spray head, said probe comprising:

a connecting portion for connecting said probe to said spray head;

a disc portion, said connecting portion and said disc portion provided with a through hole configured for accommodating said downtube of said sprayhead; and a shaft portion connected to said disc portion at one end and defining a tip end at an opposite end.

2. The apparatus of claim 1 wherein the spray head includes a movable piston and wherein the connecting portion comprises:

a first cylindrical portion having an outside diameter, the first cylindrical portion being inserted into the barrel to form a non-locking press fit with an interior of the barrel; and a second cylindrical portion having an outside diameter larger than the outside diameter of the first cylindrical portion, the second cylindrical portion forming a stop against the barrel;

wherein a downtube is inserted in the through hole of the disc and connecting portions and attached to the movable piston.

3. The apparatus of claim 2 wherein the disc portion includes a stiffener ring disposed on a lower surface of the disc portion.

4. The apparatus of claim 3 wherein an outside diameter of the stiffener ring is smaller than an outside diameter of the disc portion.

5. The apparatus of claim 3 further comprising at least two ribs extending from an inside of the stiffener ring to the through hole, the at least two ribs being disposed on opposite sides of the shaft portion.

6. The apparatus of claim 2 further comprising a second shaft portion connected to the disc portion at one end and defining a tip end at another end.

7. The apparatus of claim 1 wherein the connecting portion is generally cylindrical, an interior surface of the connecting portion forms a non-locking press fit with an exterior surface of the barrel, a downtube is inserted in the through hole of the disc and connecting portions and the downtube is attached to the barrel.

8. The apparatus of claim 7 further comprising a second shaft portion connected to the disc portion at one end and defining a tip end at another end.

9. The apparatus of claim 1 wherein the probe further comprises a generally cylindrical downtube insertion portion disposed on a lower surface of the disc portion and wherein the connecting portion is generally cylindrical, an exterior surface of the connecting portion forms a non-locking press fit with an interior surface of the barrel and a downtube is attached to the generally cylindrical downtube insertion portion by insertion therein.

10. The apparatus of claim 9 further comprising a second shaft portion connected to the disc portion at one end and defining a tip end at another end.

11. The apparatus of claim 1 wherein the shaft includes a groove formed therein.

12. The apparatus of claim 11 wherein the groove extends to the tip end of the shaft portion.

13. The apparatus of claim 12 wherein the tip end is beveled.

14. The apparatus of claim 13 wherein the groove opens on a side of the shaft opposite the connecting portion.

15. The apparatus of claim 12 wherein the groove is defined by a substantially flat portion, concave portions at each end of the substantially flat portion, and convex portions at ends of the concave portions distal the substantially flat portion.

16. The apparatus of claim 1 further comprising a second shaft portion connected to the disc portion at one end and defining a tip end at another end.

17. The apparatus of claim 16 wherein the second shaft portion is located ninety degrees around the disc portion from the shaft portion.

18. The apparatus of claim 16 wherein the second shaft portion is located one hundred eighty degrees around the disc portion from the shaft portion.

19. The apparatus of claim 16 further comprising a third shaft portion connected to the disc portion at one end and defining a tip end at another end.

20. The apparatus of claim 19 further comprising a fourth shaft portion connected to the disc portion at one end and defining a tip end at another end.

21. A rechargable spray bottle dispensing apparatus, comprising:

a spray bottle including a first neck portion;

a spray head connected to said first neck portion of said spray bottle, said spray head including a barrel and a downtube extending into the spray bottle;

an insert having at least one reservoir for containing a dose of chemical concentrate; said insert disposed within said spray bottle; and a probe configured for selectively accessing and compromising the at least one reservoir of the insert to the dose of chemical concentrate into said spray bottle, the probe being connected to the barrel of the spray head.

22. The apparatus of claim 21 wherein the probe comprises:

a connecting portion for attaching the probe to the barrel;

a disc portion, the connecting portion and the disc portion defining a through hole; and a shaft portion connected to the disc portion at one end and defining a tip end at another end.

23. The apparatus of claim 22 wherein the insert is provided with a through passageway for accommodating the downtube.

24. The apparatus of claim 23, wherein the insert is provided with a second through passageway for accommodating the probe.

25. The apparatus of claim 22, including chemical concentrate contained in said at least one reservoir or said insert.

26. The apparatus of claim 25 wherein said insert is provided with multiple reservoirs containing different types of chemical concentrate.

27. The apparatus of claim 22 further comprising a second shaft portion connected to the disc portion at one end and defining a tip end at another end.

28. The apparatus of claim 27 wherein the insert is provided with a through passageway for accommodating the downtube, a second through passageway for accommodating the shaft portion of the probe and a third through passageway for accommodating the second shaft portion of the probe.

29. The apparatus of claim 22, wherein the first neck portion is provided with external threads, and the spray head includes a coupler provided with internal threads cooperating with the external threads of the first neck portion to allow the spray head to be releasably connected to the spray bottle.

30. The apparatus of claim 22, wherein the spray bottle includes a second neck portion and a closure to allow a diluent to be added to the spray bottle without removing the spray head connected to the first neck portion of the spray bottle.

31. The apparatus of claim 30, wherein the second neck portion is provided with external threads, and the closure is defined by a resealable cap provided with internal threads cooperating with the external threads of the second neck portion.

32. The apparatus of claim 22 wherein the spray head includes a movable piston and wherein the connecting portion comprises:

a first cylindrical portion having an outside diameter, the first cylindrical portion being inserted into the barrel to form a non-locking press fit with an interior of the barrel and a second cylindrical portion having an outside diameter larger than the outside diameter of the first cylindrical portion, the second cylindrical portion forming a stop against the barrel;

wherein the downtube is inserted in the through hole of the disc and connecting portions and attached to the movable piston.

33. The apparatus of claim 32 further comprising a second shaft portion connected to the disc portion at one end and defining a tip end at another end.

34. The apparatus of claim 32 wherein the disc portion includes a stiffener ring disposed on a lower surface of the disc portion.

35. The apparatus of claim 34 wherein an outside diameter of the stiffener ring is smaller than an outside diameter of the disc portion.

36. The apparatus of claim 34 further comprising at least two ribs extending from an inside of the stiffener ring to the through hole, the at least two ribs being disposed on opposite sides of the shaft portion.

37. The apparatus of claim 22 wherein the connecting portion is generally cylindrical, an interior surface of the connecting portion forms a non-locking press fit with an exterior surface of the barrel, the downtube is inserted in the through hole of the disc and connecting portions and the downtube is attached to the barrel.

38. The apparatus of claim 37 further comprising a second shaft portion connected to the disc portion at one end and defining a tip end at another end.

39. The apparatus of claim 22 wherein the probe further comprises a generally cylindrical downtube insertion portion disposed on a lower surface of the disc portion and wherein the connecting portion is generally cylindrical, an exterior surface of the connecting portion forms a non-locking press fit with an interior surface of the barrel and the downtube is attached to the generally cylindrical downtube insertion portion by insertion therein.

40. The apparatus of claim 39 further comprising a second shaft portion connected to the disc portion at one end and defining a tip end at another end.

41. The apparatus of claim 22 wherein the shaft portion includes a groove formed therein.

42. The apparatus of claim 41 wherein the groove extends to the tip end of the shaft portion.

43. The apparatus of claim 42 wherein the tip end is beveled.

44. The apparatus of claim 43 wherein the groove opens on a side of the shaft portion opposite the connecting portion.

45. The apparatus of claim 42 wherein the groove is defined by a substantially flat portion, concave portions at each end of the substantially flat portion, and convex portions at ends of the concave portions distal the substantially flat portion.

46. A rechargable spray bottle dispensing apparatus, comprising:

a spray bottle including a first neck portion;

a spray head connected to the first neck portion of the spray bottle, the spray head including a barrel;

a downtube extending into the spray bottle;

an insert having multiple reservoirs for containing multiple separate doses of chemical concentrate, the insert being configured for selectively accessing the multiple reservoirs to allow multiple recharging of the spray bottle dispensing apparatus by the insert; and a probe for selectively accessing one or more of the multiple reservoirs of the insert, the probe being connected to the barrel of the spray head.

* * * * *